US010315449B2

(12) United States Patent
Arendt et al.

(10) Patent No.: US 10,315,449 B2
(45) Date of Patent: Jun. 11, 2019

(54) THREAD SEWING MACHINE

(71) Applicant: Mueller Martini Holding AG, Hergiswil (CH)

(72) Inventors: Holger Arendt, Grossrinderfeld (DE); Dirk Waldmann, Bad Mergentheim (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 1572 days.

(21) Appl. No.: 13/960,853

(22) Filed: Aug. 7, 2013

(65) Prior Publication Data

US 2014/0044501 A1 Feb. 13, 2014

(30) Foreign Application Priority Data

Aug. 9, 2012 (CH) ..... 01307/12

(51) Int. Cl.

| | |
|---|---|
| ***B42B 2/02*** | (2006.01) |
| ***B65H 7/20*** | (2006.01) |
| ***B65H 7/02*** | (2006.01) |
| ***B42C 19/08*** | (2006.01) |

(Continued)

(52) U.S. Cl.

CPC ..... *B42B 2/02* (2013.01); *B42B 9/00* (2013.01); *B42C 19/08* (2013.01); *B65H 5/32* (2013.01); *B65H 7/02* (2013.01); *B65H 7/20* (2013.01); *B65H 2511/20* (2013.01); *B65H 2513/50* (2013.01); *B65H 2515/84* (2013.01); *B65H 2701/1311* (2013.01); *B65H 2701/1313* (2013.01)

(58) Field of Classification Search

CPC .... B42D 1/00; B42D 5/00; B42C 9/00; B42C 11/00; B42B 5/08

USPC ..... 281/15.1, 21.1, 27; 412/1, 4, 5, 6, 7

See application file for complete search history.

(56) References Cited

U.S. PATENT DOCUMENTS 4,083,551 A * 4/1978 St. Denis ..... B42C 1/10 270/52.18

5,887,863 A 3/1999 Hollenstein et al.

(Continued)

FOREIGN PATENT DOCUMENTS

DE 202004002051 U1 4/2004

EP 0893275 A1 1/1999

(Continued)

*Primary Examiner* — Justin V Lewis

(74) *Attorney, Agent, or Firm* — Leydig, Voit & Mayer, Ltd.

(57) ABSTRACT

A method for operating a thread sewing machine to process printed sheets to form book blocks includes transporting the printed sheets lying astride a first transport section of a transport system. The first transport section is operated by a conveying mechanism. The conveying mechanism is operated with a speed change that depends on a direct sequence of different sheet lengths of the printed sheets. The printed sheets are fed from the first transport section to a second transport section of the transport system. The second transport section is operated by a conveying device having at least one of a controller and an operative connection to a stop so as to ensure an individual positioning of a sub-format printed sheet relative to a standard-format printed sheet. The printed sheets are fed from the second transport system to a downstream sewing station.

23 Claims, 4 Drawing Sheets

(51) Int. Cl.
*B42B 9/00* (2006.01)
*B65H 5/32* (2006.01)

(56) References Cited

U.S. PATENT DOCUMENTS

| | | | | |
|---|---|---|---|---|
| 6,095,740 | A * | 8/2000 | Hollenstein | B42B 2/02 270/52.26 |
| 7,815,180 | B2 | 10/2010 | Mezger et al. | |
| 8,220,793 | B2 | 7/2012 | Mezger et al. | |
| 2003/0085512 | A1 * | 5/2003 | Middelberg | B65H 31/3081 271/226 |
| 2009/0243202 | A1 * | 10/2009 | Merkli | B65H 5/32 271/254 |
| 2010/0230886 | A1 * | 9/2010 | Watanabe | B65H 45/12 270/45 |

FOREIGN PATENT DOCUMENTS

| | | | |
|---|---|---|---|
| EP | 1561599 | A1 | 8/2005 |
| EP | 2184177 | A1 | 5/2010 |
| WO | WO 9703906 | A1 | 2/1997 |

* cited by examiner

THREAD SEWING MACHINE

CROSS-REFERENCE TO PRIOR APPLICATION

Priority is claimed to Swiss Patent Application No. CH 01307/12, filed on Aug. 9, 2012, the entire disclosure of which is hereby incorporated by reference herein.

FIELD

The invention relates to a method for operating a thread sewing machine. It also relates to a thread sewing machine for carrying out a method for processing printed sheets to form book blocks.

BACKGROUND

Conventional thread sewing machines can only ever be set up for one format. This takes place by means of mechanical connections, for example by the use of multi-tooth couplings and magnetic brakes, during the setting up of production. In the course of production itself, this system cannot be adjusted, or is at least not flexible enough. This leads to problems when book blocks are to consist of signatures, also called printed sheets, of different sheet lengths, for example when, as an art print, or for design reasons, they have different formats.

In particular when printed sheets are transported on the foot side and are scanned on the head side or transported on the head side and are then to be transferred from one transport section to another, because of the inflexible format adjustment due to the machines this is not possible or only with restrictions, this regularly entailing a reduction in the production speed, a machine stoppage or the constant placing of the printed sheets by hand.

When printed sheets of various sizes are directly placed by hand on a sewing saddle, as is currently practised, dangerous safety-related sequences that are no longer permitted by the safety authorities are produced as there is thus an imminent great danger for the user of the machine of serious finger injuries.

Purely for safety-related reasons, machines with an auxiliary saddle support would therefore be preferable. The drawback in these machines is the constantly recurring monotonous movement sequence of the operator when placing the individual printed sheets opened by hand. Moreover, the risk, which is not to be underestimated, exists here of the printed sheets being able to become mixed up, which can lead to a not inconsiderable rejection rate. Nevertheless, the fact is, that a manual placing of printed sheets with different formats on the auxiliary saddle is only possible when the entrainer chain does not have a fixed position.

Another possibility for producing a book of this type with sub-format insertions is to divide this book into a plurality of parts and to then bring them together sewn by thread. In a process of this type, all the fully printed sheets, which are also called standard-format printed sheets, are firstly sewn as far as a sub-format printed sheet. All the following standard-format signatures are thereupon processed and, finally, the sub-format printed sheets are sewn. Lastly, a book is then produced with at least three thread-sewn, part-book blocks, which can be glued together in the correct order.

As the demand for books of this type, in which sub-format printed sheets are incorporated for design reasons, is increasing, the sequences that have become known in the prior art in conjunction with thread sewing machines are no longer satisfactory as, as in all the techniques that have become known, it is not possible to realise economical, safe production.

In this context and with regard to the prior art that has become known, reference is made in a subsidiary manner to the document EP 2 184 177 A1 which describes a device for thread sewing folded print products. In this case, the individual printed products are sewn by a sewing machine at their fold and sewn together to form a book block at their back having the fold, the printed products being fed in a pivotable saddle, which they individually rest astride, to the sewing station. EP 2 184 277 A1 is hereby incorporated by reference herein in its entirety.

EP 1 561 599 A1 deals with the exact and flexible positioning of standard-format, folded printed sheets on a sewing saddle, which are retrospectively bound, i.e. thread-sewn, to form a book block. The thread sewing machine inter alia has a feeder as well as a downstream sewing saddle. The printed sheets are taken over from the feeder by means of a conveying mechanism of the sewing saddle and transported into a sewing position on the sewing saddle. For this purpose, the conveying mechanism has a drive connection to a rotation-angle controlled electric motor configured by a computer-linked controller. The computer has a data memory, in which data corresponding to the format of different printed sheets are stored, whereby the conveying mechanism can easily be adjusted or converted to the specific format size of the printed sheets to be processed. In addition, a stop corresponding to the sewing position of the printed sheets and determining the end position of a printed sheet can be arranged on the sewing saddle, said stop being used to orient the front edge of the respective printed sheet. As an alternative or in addition, a sensor determining the end position of a printed sheet and oriented to the sewing saddle may also be allocated to the sewing position. All the variants of this solution are, however, merely oriented to the exact and flexible positioning of standard-format printed sheets, so this solution does not make any contribution to the production of book blocks consisting both of standard-format and sub-format printed sheets.

SUMMARY

In an embodiment, the present invention provides a method for operating a thread sewing machine to process printed sheets to form book blocks. The printed sheets are transported lying astride a first transport section of a transport system. The first transport section is operated by a conveying mechanism. The conveying mechanism is operated with a speed change that depends on a direct sequence of different sheet lengths of the printed sheets. The printed sheets are fed from the first transport section to a second transport section of the transport system. The second transport section is operated by a conveying device having at least one of a controller and an operative connection to a stop so as to ensure an individual positioning of a sub-format printed sheet relative to a standard-format printed sheet. The printed sheets are fed from the second transport system to a downstream sewing station.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
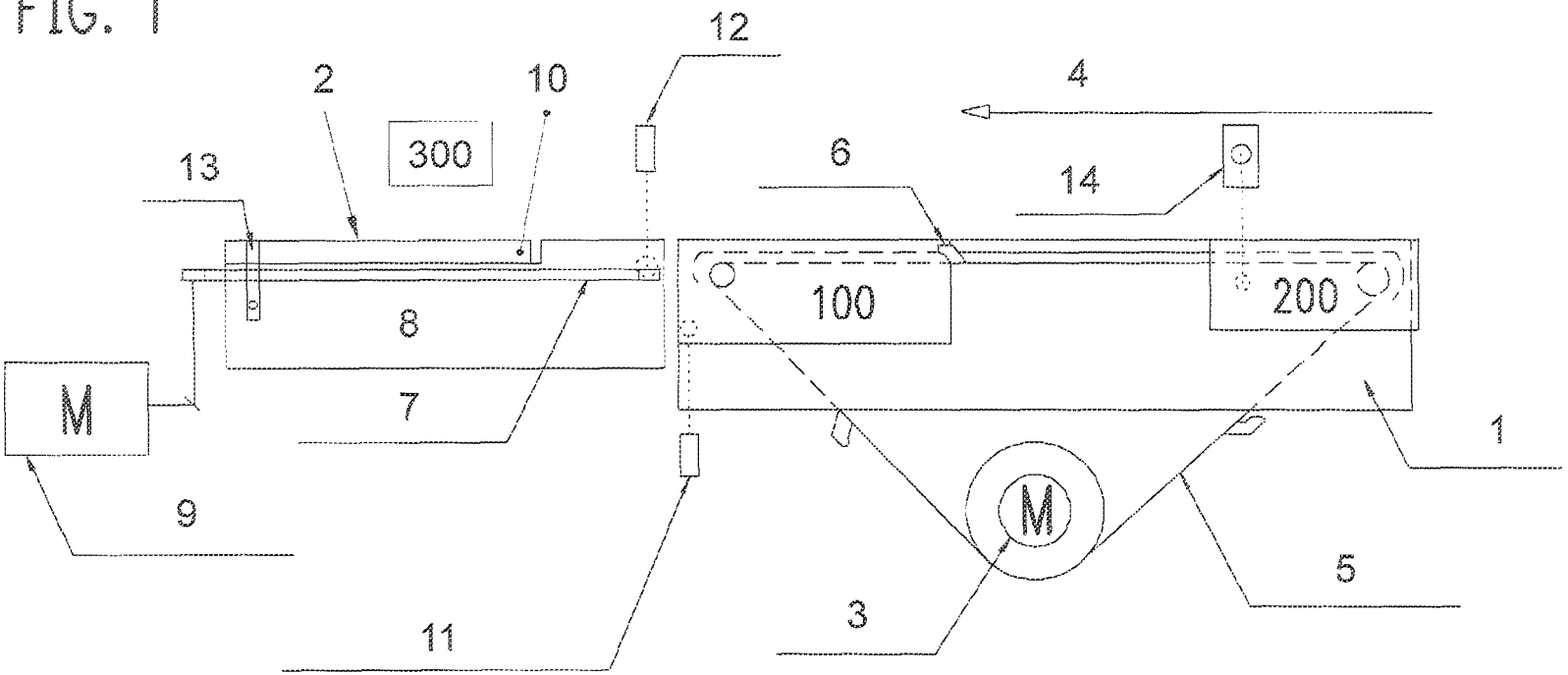
FIG. 1 shows an auxiliary saddle and sewing saddle having an operative connection to one another in the transporting direction of the printed sheets, a standard-format printed sheet being located on the auxiliary saddle, followed by a sub-format printed sheet.

In an embodiment, the invention provides a remedy to the problems associated with the prior art discussed above. The invention, in an embodiment, is based on bringing about a positioning of printed sheets of different formats in front of a sewing station in a method for operating a thread sewing machine and a thread sewing machine for carrying out a method for processing printed sheets to form book blocks of the type mentioned at the outset, so that a completely automated production of book blocks becomes possible. In an embodiment, the invention also introduces sub-format printed sheets in a specific position within a composite structure of standard-format printed sheets.

A transport section for printed sheets is proposed here according to an embodiment of the invention, which is operated between an opener system acting upstream and a sewing station arranged downstream. This transport section substantially consists of a first transport section, called an auxiliary saddle in thread sewing machines, and a downstream second transport section, called a sewing saddle in thread sewing machines.

Auxiliary saddle and sewing saddle are common expressions in the industry and are intended to express that these are autonomously acting part-transport sections, which, however, have an operational interdependence with respect to one another regarding the transportation of the printed sheets. The method according to an embodiment of the invention is integrally operated independently of the starting position, whether purely "standard-format" printed sheets are transported, or whether intermittently, i.e. as required, "sub-format" printed sheets arrive for processing.

Furthermore, it is important to the invention in an embodiment that the insertion of sub-format printed sheets into the standard-format printed sheets can be extended such that the first-mentioned printed sheets can be positioned in any desired position or in a specific position within a book block. In other words, sub-format printed sheets in a book block, compared to the standard-format printed sheets, can be selectively positioned head-aligned (left-aligned on the sewing saddle in the transport run), foot-aligned (right-aligned on the sewing saddle in the transport run), centrally or in any desired position, and can be sewn, it being assumed here that the sewing saddle operates to the left of the auxiliary saddle, viewed from the front in the transporting direction.

An important advantage of an embodiment of the invention is to be seen in that the proposed feed system is in a position to feed printed sheets with different formats or different sheet lengths, within an uninterrupted production, to the sewing station safely, in the correct position and without losses of production.

The possibility is thus provided here according to an embodiment of the invention to sew sub-format printed sheets, special printed sheets or other insertions, into a book or a book block, without interrupting the sewing process or subsequently having to bring together book parts.

In this case, the following precautions are taken according to an embodiment of the invention or integrated interdependently with respect to one another into the feed system:

The drive of the entrainer chain belonging to the auxiliary saddle, which hitherto took place mechanically or was rigidly adjusted by means of a multi-tooth coupling and a magnetic brake when setting up for a specific format, is preferably replaced by an asynchronous motor which is controlled by a servo invertor. It is thereby possible to control the entrainer chain during production in such a way that it can in each case adapt to the sheet length of the printed sheet currently located on the auxiliary saddle. This takes place at full production speed, so the components hitherto used, such as the drive, multi-tooth coupling, and magnetic brake, can be dispensed with.

It should be mentioned here that a predetermined sequence input into the central control of the printed sheets arriving to be processed is paramount. In the meantime it is also possible to superimpose selective system changes or interventions on this sequence. The controlled sequence also ensures that intermediary, necessary idle cycles can be inserted on the introduction of different printed sheets.

It is also possible to provide a further detecting unit within the transport section belonging to the auxiliary saddle, which triggers the following control steps:

a) an interim acceleration of the entrainer chain is triggered in the case of a transported sub-format printed sheet, b) an idle cycle without the feeding of a printed sheet is inserted following the sub-format printed sheet, c) a controlled delay of the entrainer chain is triggered in the case of a standard-format printed sheet following the idle cycle.

The detecting unit mentioned can readily be operated independently, or it can be provided redundantly with respect to the sequence fixed beforehand of the printed sheets to be transported.

A book to be sewn consists, for example, of 10 printed sheets, it being assumed for explanation that 9 printed sheets are standard-format, i.e., they have the same format size, and one printed sheet is assumed to be sub-format, this signifying a shorter sheet length. In this starting position, the introduction of all the printed sheets firstly takes place in accordance with uniform principles, in other words with either the head or foot side leading. If the magazines are loaded individually or the introduction, by way of exception, takes place by hand, the sequences fixed at the outset always have to be strictly adhered to.

The thread sewing machine directs its production, i.e. its cycles, to the largest format to be sewn. The feed system feeds the printed sheets consecutively from the magazine via an opener system toward the auxiliary saddle astride, where the individual printed sheets are received on the foot side by an entrainer element (entrainer finger) and conveyed onward until they can then be taken over at the head side by a sheet feed system belonging to the sewing saddle, the takeover of the printed sheets taking place at the head side here. Directly after this takeover, the printed sheets are transported onward at great acceleration along the sewing saddle. To the observer, this process appears to proceed as if the printed sheets were literally pulled away or shot away from the auxiliary saddle by the sheet feed system belonging to the sewing saddle.

This procedure remains unchanged until the withdrawal of a sub-format printed sheet from the magazine is called for. In the subsequent sequence, an empty sheet is then produced, i.e. an idle cycle, in which no further printed sheets are directly withdrawn, is operated in the interim after the sub-format printed sheet, so a gap is produced in the transport run. The relevancy of this gap will be dealt with in more detail below.

If the sub-format printed sheet in association with the remaining printed sheets has the No. 5, this produces the following printed sheet order: 1, 2, 3, 4, 5, 0, 6, 7, 8, etc., 0 symbolising the empty sheet here. With an empty sheet, the process is such that the machine does not pull a sheet from the magazine, so an empty point or gap is produced in the material flow along the transport section, which gap is then recognised in the sewing centre of the sewing station and is implemented as a blind stitch.

This recognition or the predetermined specification that sub-format printed sheets arrive for transportation, and then an empty point has to be inserted, triggers various sequences:

On entry into the sheet insertion system belonging to the sewing saddle, the printed sheets are preferably firstly detected on the head side by means of a photocell. At this time, the spacing between the entrainer element and sheet insertion system precisely corresponds to the adjusted sheet length of the standard-format printed sheets. If the printed sheet No. 5 now arrives for transport with a sheet length smaller by A compared to that of the standard-format printed sheets on the auxiliary saddle, this printed sheet No. 5 with a conventional format adjustment would arrive at the sewing saddle later by a length amount A, and accordingly could no longer be grasped on the head side in the desired manner by the sheet insertion system and transported onward. A collision would then undeniably occur with the sewing saddle already moving into the sewing position, which would then lead to a stoppage of the system.

The picking up of these format differences is brought about by a feed system in an operative connection with a central controller as follows:

The independently driven entrainer chain now pushes the printed sheet onward by the Δ-length amount in the transport direction by means of the associated entrainer element during the transport section on the auxiliary saddle. This takes place by means of an interim acceleration of the entrainer chain. As soon as the Δ-length amount has been made up for, the entrainer chain takes up its original transporting speed again. This measure therefore ensures that the sub-format printed sheet edge, which is the head side of the corresponding printed sheet, is at the sewing saddle at the same time as was the case one cycle earlier with respect to the standard-format printed sheet, whereby the detection taking place there confirms the orderly production sequence and clears it.

This means that the sheet insertion system of the sewing saddle can operate independently of the format, in that a detection of the front edge of the printed sheet is firstly carried out followed by a detection of the rear edge thereof, the respective confirmation that the rear edge of the respective printed sheet has also passed the transition between the auxiliary saddle and sewing saddle at the correct time signifying an assurance that both sub-format and standard-format printed sheets are placed in the precise position and completely on the sewing saddle.

During the idle cycle 0 now following, after the sub-format printed sheet, the entrainer chain is automatically set again to the original length of the standard-format printed sheet by a negative acceleration (delay). The Δ-length amount is now reset again by the printed sheet transportation now running more slowly, whereby the feed system has now adopted the original state again in relation to the standard-format printed sheets.

If a plurality of printed sheets 5 now follow one another, the negative accelerations are now first of all omitted, and the idle cycles 0 relating to the number of printed sheets 5 following one another are firstly likewise omitted.

If sub-format printed sheets following one another have different sheet lengths, production can still be made continuous in that corresponding idle cycles are inserted, in which a respective acceleration/delay of the entrainer chain is carried out in relation to the sheet lengths of the printed sheets to be processed. Moreover, it is always possible to reposition the feed system by the insertion of idle cycles.

According to an embodiment of the invention, depending on the position of the sub-format printed sheets relative to the standard-format printed sheets in the transport run, a defined stroke section is allocated to each printed sheet to be sewn of the book block. This can either have been predetermined manually at the operating panel of the controller, or it is calculated from information read from the JDF data of the instruction ticket, or is controlled by means of at least one barcode printed on the printed sheet, the control unit operating for this transmitting the incoming information to a servo motor for example.

In detail, the detection of the different printed sheet formats will proceed as follows: Firstly, a standard-format printed sheet is allocated the stroke section X. A sub-format printed sheet which is to be sewn head-aligned (left-aligned in the transport run) is consequently also allocated the stroke section X. To optimise the movement sequences, the sewing saddle can now be moved directly after the detection of the rear edge of this printed sheet toward the sewing centre.

A sub-format printed sheet which is to be sewn centrally, foot-aligned (right-aligned in the transport run) or in any desired position within the book block is allocated the stroke section X to Y, the value Y corresponding here to the selected spacing of the sub-format printed sheet relative to the head alignment of the standard-format printed sheet.

The feed system according to an embodiment of the invention has the following advantages:

Basically, the manual activities of the user can be eliminated completely with the subject matter according to an embodiment of the invention and, at most, such interventions approximate zero. On the one hand, it is thereby ensured that the safety specifications to prevent accidents can be adhered to. On the other hand, it is ensured that incorrectly assembled book blocks are not produced owing to lack of attention of the operator.

If, in the meantime, the possibility of a manual intervention is not to be completely dispensed with, for this purpose it has to be provided that the entrainer element, or the entrainer elements in complementary entrainer chains, are protected by profile parts, so that the operator of the machine cannot be caught by these entrainer elements during manual execution.

In the meantime, in specially designed editions of book blocks, it can certainly make sense for certain sub-format printed sheets to be able to be placed on the auxiliary saddle by hand. If this is the mode of proceeding, the previously adjusted cycle sequence of the thread sewing machine intervenes, in that the machine inserts a stop in the sense of an idle cycle to insert a printed sheet of this type. Once the corresponding printed sheet has been inserted, the machine resumes its proper production. As the auxiliary saddle of the thread sewing machine can be adequately safeguarded by a protective door with a protective switch and confirmation sensors, the operator of the machine is not in danger at any time.

An important advantage of an embodiment of the invention is moreover to be seen in the fact that a mechanism is provided, which allows positioning the sub-format printed sheets fully automatically and in any desired position on the sewing saddle within a standard-format book block.

All the printed sheets to be sewn, even the sub-format ones, are always located at the same time (angular degree of the machine) at the entrance of the sheet insertion system belonging to the sewing saddle in such a way that the front edge in the conveying direction of each printed sheet passes the transition between the auxiliary saddle and sewing saddle at the correct time.

The sensor for controlling the servo motor to operate the sheet insertion system has a mechanically defined position within the transport section and is not adjustable, ensuring that reproducibility is ensured in the sequences.

A displacement path (stroke section) which, depending on the desired position within a book, can be different, is allocated to all the printed sheets to be sewn. Books with different formats with or without sub-format printed sheets can consequently be processed. The number and the position of the sub-format printed sheets are whatever is desired and may be different from book to book. Such books may be conventionally printed or produced digitally, the prerequisites for "on-demand" books coming to the fore particularly advantageously in the latter method.

The information about the displacement path (stroke section) can be incorporated manually via Commander or by means of indications (barcodes) printed on the printed sheets or by means of RFID radio chips, which are incorporated into the printed sheets, or transmitted from a superordinate control system (for example via JDF data) or from a database to the controller of the sheet insertion system.

An adjustable stop located on the sewing saddle is predestined according to intended use, to preferably be used for the largest printed sheet to be sewn of the respective book block, it then having to be selected whether the head-side positioning of the introduced printed sheet is set up only by the stop or by the displacement path determined by the controller, and whether if need be a redundancy is to be provided between the two precautions.

In the meantime, it can also be advantageously provided according to an embodiment of the invention that the sewing saddle is provided with an adjustable and motor-driven stop which, in each machine cycle, can also adopt a different position on the sewing saddle by an automatic adjustment, it also being possible to use the adoption of this position only as an alternative in cooperation with the respective displacement path predetermined by the controller, also, if need be, only in a redundant manner.

The prerequisite of a mode of functioning of this type is always, however, that the sub-format printed sheets are also always located at the entrance of the sheet insertion system at the same time. The detection or at least the monitoring of the presence of the printed sheet at this point is therefore of great importance for the mode of functioning of the whole thread sewing machine.

An advantageous embodiment variant of the stop may also be that positive, nubbed belts can be used, such nubs moving ahead of the printed sheet in the conveying direction, and being able to be used as a freely positionable stop during any desired positional stopping of the system in any desired position on the sewing saddle.

The feed system described here in conjunction with a thread sewing machine can, in addition, also be used on purely collecting sewing devices, where it is a question of producing a printed product with printed sheets or with other enclosures with different format lengths, in fact so as not to be thread-sewn, but to be transported on the foot side and to be conveyed onward in the precise position on the head side.

A format change can take place automatically at full machine speed within production, regardless of whether these are smaller or larger printed sheet formats.

With the aid of the system according to an embodiment of the invention, it is possible to position sub-format printed sheets with a shorter back length within a book block in any desired position and fully automatically, which was previously only possible manually. The system according to an embodiment of the invention thus also offers the possibility of basically dispensing with stops, or only including them at points where it makes sense.

FIG. 1 shows a transport section for printed sheets, which is located between an opener system and a sewing station 300. This transport section consists of an auxiliary saddle 1 and a downstream sewing saddle 2. The auxiliary saddle 1 and sewing saddle 2 are autonomously acting part-transport sections per se; however, for the transportation of the printed sheets, they have an imperative interdependence with one another, i.e. they have an operative connection to one another. This starting position consists per se independently of whether purely "standard-format" printed sheets 100 are transported or whether "sub-format" printed sheets 200 are transported intermittently.

The selected terminology with regard to "standard-format" and "sub-format" in the meantime states nothing other than that the standard-format printed sheets have a uniform dimensioning which coincides with the actual size of the book block. The sub-format printed sheets are printed sheets of the type which have a smaller dimensioning compared to the standard-format printed sheets. Basically, the sub-format printed sheets may have deviations both with respect to their sheet length and also to their sheet width, the sheet width not being significant here in the transportation according to an embodiment of the invention.

It is therefore a question primarily of continuously machining printed sheets with different sheet lengths, which can generally occur individually or intermittently, without stopping the transport system or having to allow other measures to be included.

It is therefore unimportant in the present transport system what cadence is taken as a base, and after what intermittence the different printed sheets follow one another. Basically, the sub-format printed sheets may thus occur distributed over the entire book block, or form a coherent package within the book block.

FIG. 1 shows what matters here when transporting printed sheets that are positioned astride with different sheet lengths. First of all, it can be seen in FIG. 1 that the auxiliary saddle 1 has an autonomous conveyance of the printed sheets 100, 200, which lastingly ensures the onward conveyance in the correct position in the sheet transporting direction 4 by a motor 3 with a rotary encoder and chain wheel. The initial transportation of the printed sheets to the auxiliary saddle 1 is not shown in more detail; nor is the opener system shown in more detail, in which the printed sheets are opened and also not shown in more detail is a conveyor belt, along which the printed sheets 100, 200 are non-positively grasped and conveyed onward. These elements are known to the person skilled in the art.

When the printed sheets have then been advanced at least over their entire sheet length on the auxiliary saddle 1, for the further positionally stable conveyance of these printed sheets, a peripheral entrainer chain 5, which is driven by the motor 3 mentioned and is equipped with entrainer elements 6, also called entrainer fingers, which are spaced apart from one another, intervenes.

Since the printed sheets rest astride the auxiliary saddle, the entrainer elements 6 can easily bring about the grasping thereof, as each entrainer element 6 only acts per se on one printed sheet which is grasped laterally and below the sheet back by the entrainer element 6. The entrainer element 6 thus pushes the printed sheet grasped on the foot side in a clocked manner along the auxiliary saddle 1 forward in the direction of the sewing saddle 2.

FIG. 1, in a flash-like manner, shows a position here of the transported standard-format printed sheet 100 which is located at the end of the auxiliary saddle 1 or directly in front of the sewing saddle 2. In this position, the printed sheet 100 is thus located at the engagement point of a sheet insertion system 7 belonging to the sewing saddle 2. The printed sheet 100 is thus firstly pushed by the entrainer element 6 in the direction of the sheet insertion system 7 and the printed sheet is then taken over or grasped there on the head side by a sheet insertion system 7 driven by a servo motor 9 and conveyed onward on the sewing saddle 2 with acceleration. The sewing saddle 2 is located during this transport sequence carried out by the sheet insertion system 7 in what is known as a loading position.

It should be noted here that the sewing saddle 2 has a lower-side pre-saddle 8 which basically carries out the vertical movement of the sewing saddle 2; the concluding pivotable movement of the sewing saddle 2 loaded with the printed sheet to the sewing station 300 is generally carried out by an upper part 10 belonging to the sewing saddle 2. This means that the sewing saddle 2, from its loading position, guides the printed sheets by means of a vertical/pivotable movement to the sewing station 300.

FIG. 1 furthermore shows that the next printed sheet 200 with a sub-format sheet length coming from the opener system 4 has already reached the auxiliary saddle 1, this printed sheet 200 also being grasped in the same manner as the previous standard-format printed sheets 100, by the next-following entrainer element 6 and transported ahead. Firstly, however, the standard-format printed sheet 100 moving ahead has to have been transferred in conformity with the cycle to the sewing saddle 2.

For this purpose, a monitoring function is provided, which exists owing to a detecting sensor 11 at the end of the auxiliary saddle 1, which sensor determines a correct absolute position of the respective printed sheet, in that the front edge thereof is firstly detected. If the detection carried out confirms that the two prerequisites (position and qualification of the printed sheet) are provided, the arriving printed sheet, shown as the printed sheet 100 in FIG. 1, can be properly transferred to the sewing saddle 2 located in the loading position. The printed sheet 100 grasped on the head side by the sheet insertion system 7 is now transported with the implementation of a strong acceleration on the sewing saddle 2 and conveyed onward into the region of an end position, from where this printed sheet is then fed to the sewing station 300. The same sensor 11 also continuously detects that the foot-side edge of the respective printed sheet has passed this position at the end of the auxiliary saddle 1 in conformity with the cycle.

Once the sensor 11 has detected the position and presence of the printed sheet, in an operative connection to the sheet insertion system 7, arranged at its inlet is a further sensor 12 having a defined position, which is connected to the controller of the servo motor 9 which, as already mentioned, forms the drive of the sheet insertion system 7 configured, for example, with a pair of belts. If the sensor 12 detects the printed sheet, a signal is emitted to the controller of the servo motor 9 to cover a displacement path X with a curve allocated to the printed sheet. The displacement path X is slightly longer in the normal case than the back length of the maximum format of the book block to be sewn, in other words the standard format, in other words the back length of the book block. As already mentioned, the servo motor 9 firstly accelerates the printed sheet and, towards the end of the displacement path X, decelerates it and brings it to a standstill there.

Figure 2:
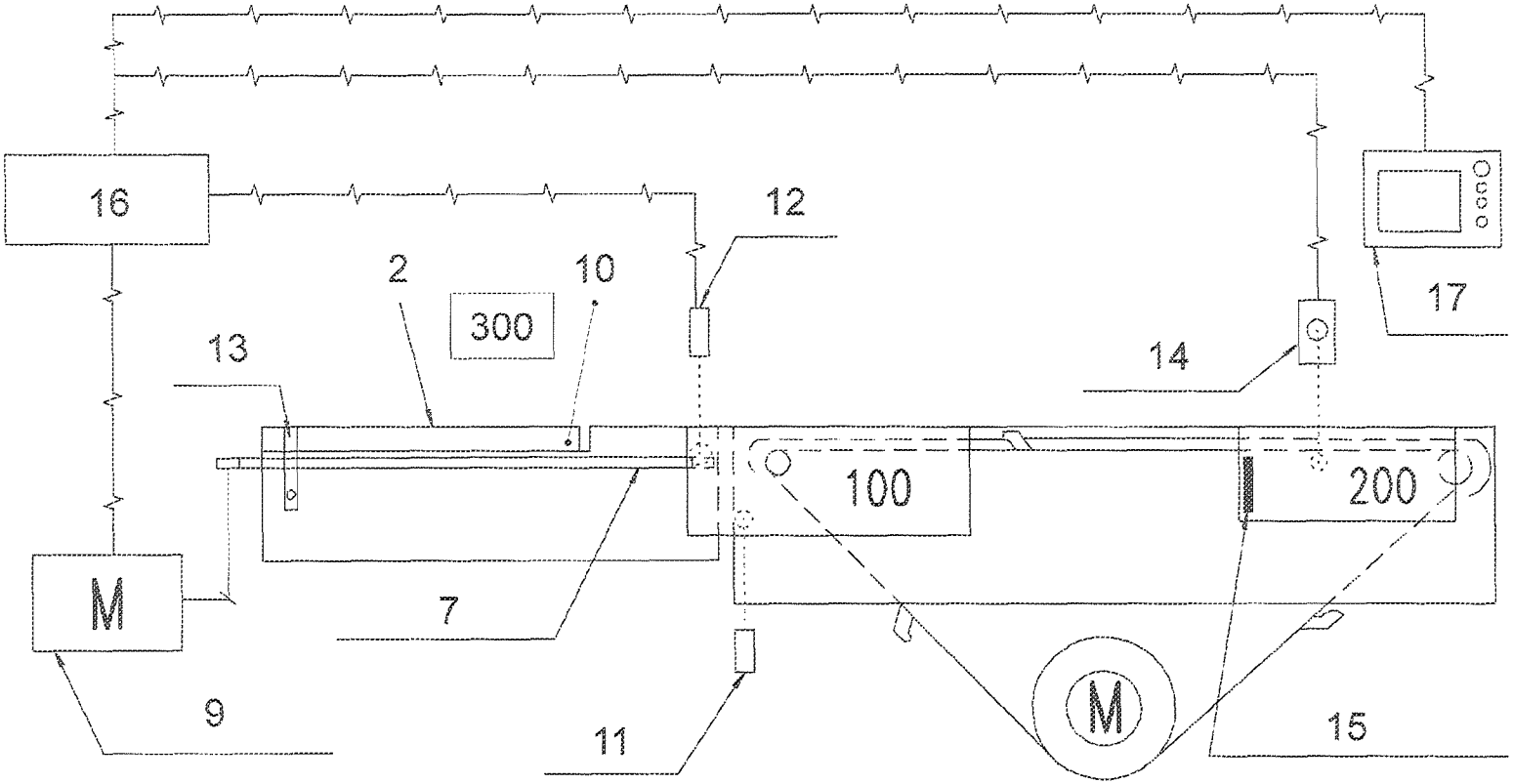
FIG. 2 shows a transport situation, in which the standard-format printed sheet is partially located on the sewing saddle, while the sub-format printed sheet is transported on the auxiliary saddle.

The system for detecting the printed sheets can also be supplemented by a further reading device 14 which reads-in the lift allocated to the printed sheet and then transmits this information to an automation unit, as emerges from FIG. 2, Pos. 16.

Furthermore, the example shown here according to FIG. 1 assumes that the printed sheets 100, 200 are pushed forward along the auxiliary saddle 1 on the foot side by the entrainer elements 6 and are then grasped on the head side by the sheet insertion system 7 of the sewing saddle 2. A position specification of this type does not have to be understood as imperative, however, as the printed sheets could also be delivered by the opener system 4 rotated through 180° and then the pushing brought about by the entrainer elements 6 would take place along the auxiliary saddle 2 on the head side, and the printed sheets would then consequently be grasped on the foot side by the sheet insertion system 7 and transported onward along the sewing saddle 2.

Basically, the positioning of an individual printed sheet on the sewing saddle can be brought about, whether the sheets are standard-format or sub-format, exclusively by the controller, this controller, in the extreme case, also being able to continuously predetermine a changed position of the individual printed sheets.

With specific specifications, the positioning of the individual printed sheets can also be achieved exclusively by the activation of at least one stop. In other words, it is also basically possible to operate with a stop 13 which, on the sewing saddle 2, marks the head-side end position of the standard-format printed sheet 100, and, if need be, also forms a stop point of a sub-format printed sheet 200 which is positioned so as to be head-aligned, in other words left-aligned.

7

Moreover, the positioning of the individual printed sheets predetermined by the stop can also be brought about for sub-format printed sheets determined so as to not be head-aligned, in that the stop (owing to the controller) can adopt its position in accordance with the size and the position to be adopted of the corresponding printed sheet in association with the others. The stop can thus continuously change its position by substantially horizontal displacements. It is also possible for the stop to rise up suddenly from the sewing saddle in a pin shape at the correct site at the correct time.

Basically, a combination of the two described positioning systems can also be taken as a base, the focal point of use of one system being able to be taken as a base in combination with the other one as the case arises. In other words, for example, the head-side positioning of a standard-format printed sheet can be brought about purely by means of the controller, and, for example, achieve the foot-side or intermediate positioning of a sub-format printed sheet by the activation of the stop. Reverse procedure sequences are obviously also possible.

The two positioning systems can also be used in a redundant manner.

With a specification of this type, the procedure in terms of control is as follows. As the sub-format printed sheet 200 has a sheet length smaller by Δ than the standard-format printed sheet 100, the next entrainer element 6 arriving in conformity with the cycle is located by the amount mentioned too far from the sub-format printed sheet 200, because this entrainer element is still adjusted to the standard format of the preceding printed sheet 100. So that the entrainer element 6 now being used can catch up with the sub-format printed sheet 200 moving ahead, the entrainer chain 5 is accelerated accordingly by the motor 3, which can preferably also be an asynchronous motor, by means of the controller, i.e. an additional path is made up by the Δ-amount compared to the machine speed by means of the interim acceleration. As a result, the sub-format printed sheet 200 located on the auxiliary saddle 1 is pushed onward by an additional Δ-path in the direction of the sheet insertion system 7, this Δ-amount corresponding to the sheet length difference from one another of the two printed sheets 100, 200. As a result, the position of the sub-format printed sheet 200 is displaced as a whole by the difference Δ, which makes up the sheet length difference between the two printed sheets 100 and 200. The information about by what difference Δ the entrainer chain additionally has to be moved, is inferred by the controller from the data available to it, which come from the data belonging to the corresponding sheet, or the signal coming from the sensor 14 is used to determine the length of the sub-format sheet.

By means of the acceleration transmitted by the motor 3 to the entrainer chain 5, the entrainer element 6 being used makes up the sheet length difference by the difference Δ, and then travels onwards at the original machine speed. Therefore, this interim acceleration means that the entrainer element 6 mentioned can catch up with the sub-format printed sheet 200 in a targeted manner.

In the gaps between the individual sheets, the sewing saddle 2 is integrally moved, in other words including the elements thereof, to the sewing station 300 and back by a vertical/pivotable movement.

The acceleration triggered by the sheet insertion system 7 and acting on the printed sheets is preferably brought about by the servo motor 9 already mentioned, which, after the grasping of the printed sheet, is directly greatly accelerated. Towards the end of the transport section determined on the sewing saddle 2, a delay occurs so the edges of the transported printed sheet do not impinge too hard against the stop 13 provided there. This stop is used as a head-side orientation for all the printed sheets arriving there before they are fed to the sewing station 300. If small differences can be tolerated in the orientation of the printed sheets, work can also take place without using a stop, which can preferably be considered in the case of printed sheets made of thin paper.

If the sub-format printed sheets 200 do not correspond in a head-aligned manner on the head side with the remaining standard-format printed sheets 100, for example in that the sub-format printed sheets are oriented on the foot side or to be placed in an intermediary manner, this can be achieved in that the predetermined position is set up by a dynamically movable stop oriented to the sub-format printed sheets.

A further possibility according to an embodiment of the invention consists in the end position of the sub-format printed sheets compared to the standard-format printed sheets being achieved purely by a control of the drive having an operative connection to the sewing saddle 2, in other words without using a stop.

As a further possibility an embodiment of the invention makes provision for the respective positioning of the standard-format and sub-format printed sheets 100, 200 on the sewing saddle 2 by a matching between the position set up purely by a drive and/or by a stop.

FIG. 2 shows the important elements of a control system, which depict a control-dependent positioning of the sub-format printed sheets within a composite structure of standard-format printed sheets.

A defined displacement path (stroke section) is allocated to each printed sheet to be sewn, belonging to the book block. This stroke section can either be achieved manually or via information (barcode) 15 printed on the printed sheet or by a superordinate control unit (external) of at least one servo motor.

Figure 3:
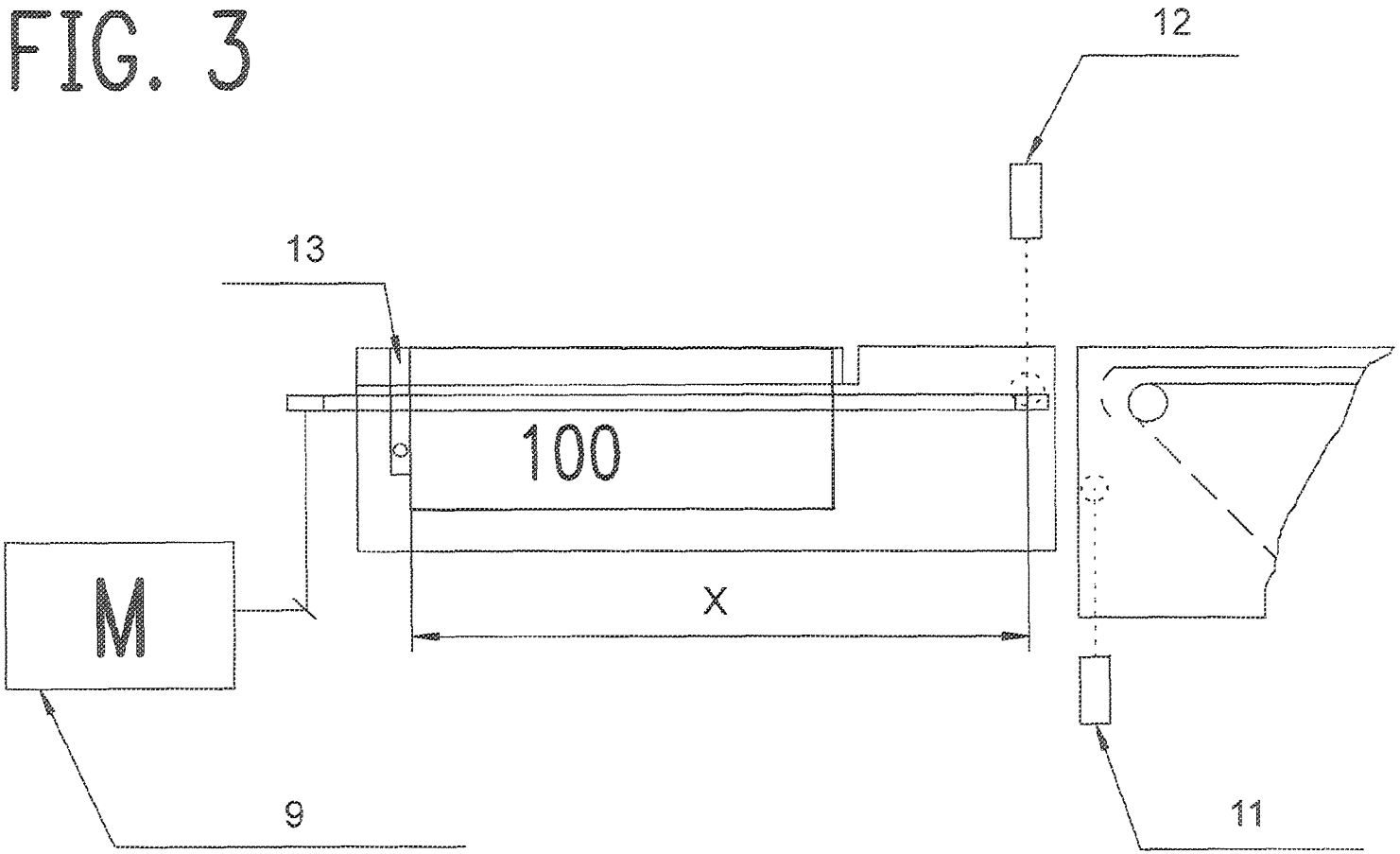
FIG. 3 shows a subsequent further transport situation, in which the standard-format printed sheet has reached its end position on the sewing saddle.
Figure 4:
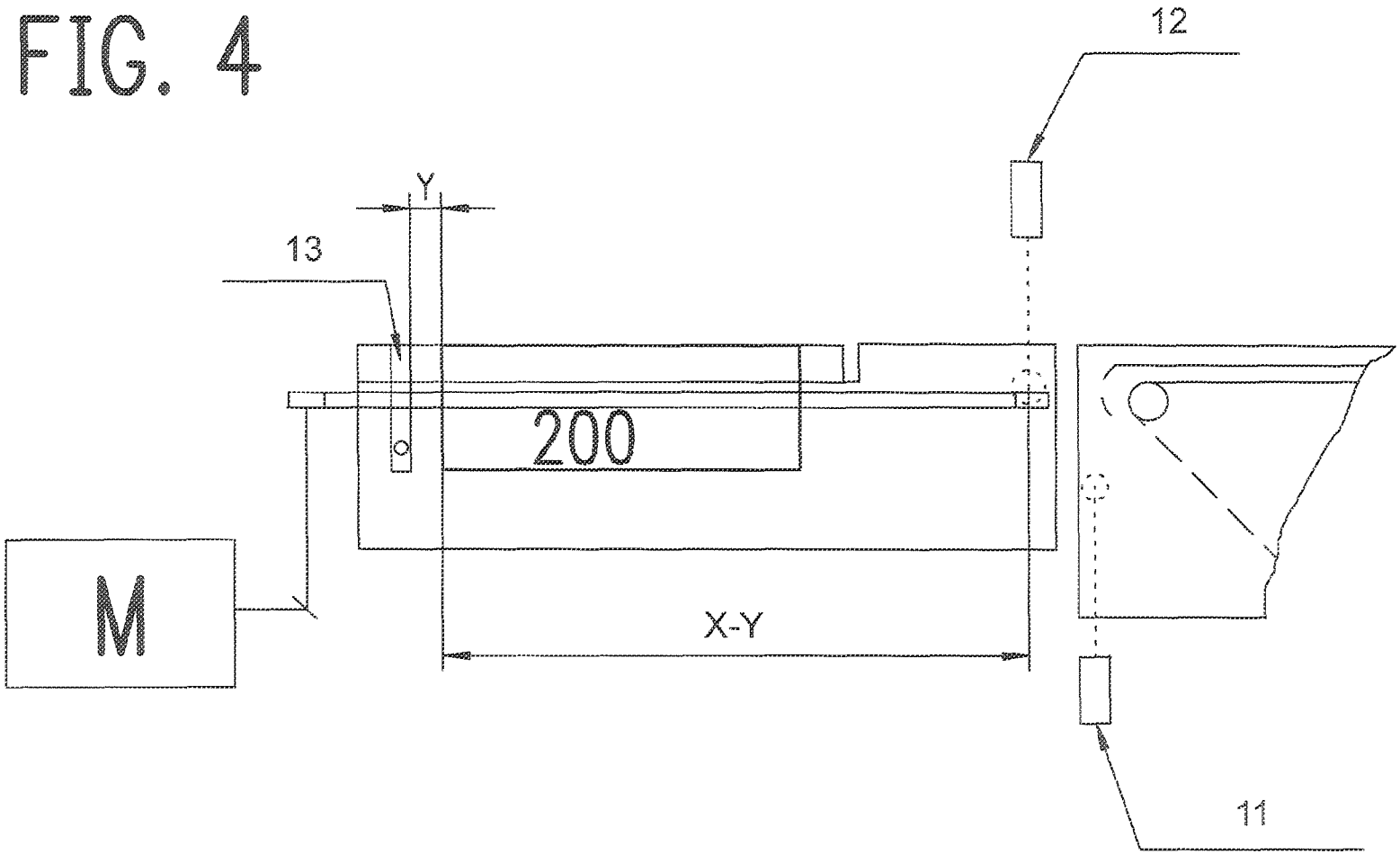
FIG. 4 shows a subsequent further transport situation, in which the sub-format printed sheet on the auxiliary saddle has reached the end position allotted to it.

A standard-format printed sheet 100 is allocated the stroke section X. A sub-format printed sheet 200, which is to be sewn head-aligned (left-aligned), is also allocated the stroke section X (see FIG. 3). A sub-format printed sheet, which is to be sewn centrally, foot-aligned (right-aligned) or in any desired position within the book block, is allocated the stroke section X to Y (see FIG. 4). The value Y corresponds here to the selected spacing of the sub-format printed sheet 200 relative to the head stop of the standard-format printed sheet 100.

An embodiment of the invention is to be illustrated with the aid of the following example.

A book block to be sewn has a back length of 400 mm and consists of 20 printed sheets. Of these, 17 printed sheets are "standard-format" with a 400 mm back length and 3 printed sheets are sub-format with a 300 mm back length. These 3 sub-format printed sheets are for example the $5^{th}$, $11^{th}$ and $16^{th}$ printed sheets within the book block to be sewn.

In this case, the $5^{th}$ printed sheet is to be positioned head-aligned (left-aligned) within the book block. The $11^{th}$ printed sheet is to be positioned centrally and the $16^{th}$ printed sheet is to be positioned foot-aligned (right-aligned) within the book block.

The displacement path X (stroke section) of the standard-format printed sheets is, for example, 600 mm (transport section+sheet length). The stroke section of the printed sheet No. 5 is also 600 mm. Located at the end of the transport section, as already explained thoroughly under FIG. 1, is a mechanical stop, against which the standard-format printed sheets and the left-aligned or head-side sub-format printed sheets can strike, so it is not imperative per se to resort to positioning by a controlled path section.

The stroke section of printed sheet No. 11 is 550 mm (transport section+sheet length−half the sheet length difference). The stroke section of the printed sheet No. 16 is 500 mm (transport section+sheet length−sheet length difference) . These printed sheets therefore do not touch the head-side mechanical stop, but thus have to be freely positioned and stopped at the position allocated to them and held in this position by non-positive engagement. Therefore printed sheet No. 5 is positioned left-aligned, printed sheet No. 11 centrally and printed sheet No. 16 is positioned right-aligned within a book block.

The following process describes the displacement path of a standard-format printed sheet 100 with a back length of 300 mm on the sewing saddle and, in the following cycle, the displacement path of a sub-format printed sheet 200 with a back length of 230 mm. This printed sheet is to be sewn 35 mm from the head stop of the standard-format printed sheet. This means that the printed sheet is consequently to be placed centrally within the book block:

Printed sheet 100 is allocated a stroke section of 500 mm. Printed sheet 200 is allocated a stroke section of 465 mm. This information is either input (Commander) 17 manually into the controller, printed (barcode) 15 on the printed sheets and read-in by means of a sheet recognition system (for example ASIR) or barcode reader 14 or transmitted to the controller by means of RFID chips incorporated in the paper, plus associated reading device. As already described above, the data can also be taken from a database or calculated from data taken from a superordinate control system from the JDF data.

The positioning of the printed sheets with different sheet lengths will be described in more detail with the aid of the following example.

A machine cycle, in which a printed sheet is placed and sewn, corresponds to 360°. The given angular degrees of the machine reflect the position of the machine within the cycle, but they are to be understood only as guidelines and may mutually intersect as long as the transportation of the sheet does not thus lead to disturbances.

1st Cycle

230°: The printed sheet 100 reaches the entrance of the sheet insertion system 7 and is checked for presence by a sensor 11, and then transported onward.

270°: The printed sheet 100 is mechanically grasped by the insertion belts of the sheet insertion system.

275°: The sensor 12 of servo motor 9 recognises the printed sheet 100 and emits a signal to the controller of servo motor 9 to now cover the displacement path of 500 mm allocated to the printed sheet 100.

276° to 60°: The printed sheet 100 is moved by 500 mm, transported onto the sewing saddle 2 and then stopped.

About 40° to 235°: The sewing saddle 2 pivots into the sewing centre and the printed sheet 100 is sewn. The sewing saddle 2 then returns to its starting position and the process begins from the start.

2nd Cycle

230°: The printed sheet 200 reaches the entrance of the sheet insertion system and is checked for presence by the sensor 11 and then transported onward, as has also been thoroughly described above, under FIG. 1.

270°: The printed sheet 200, as already described, is also mechanically grasped by the insertion belts of the sheet insertion system.

275°: The sensor 12 of servo motor 9 recognises the printed sheet 200 and emits a signal to the controller of servo motor 9 to now cover the displacement path of 465 mm allocated to the printed sheet 200.

276° to 60°: The printed sheet 200 is moved by 465 mm, transported onto the sewing saddle 2 and then stopped.

About 40° to 235°: The sewing saddle 2 pivots into the sewing centre and the printed sheet 200 is sewn. The sewing saddle then returns to its starting position and the process begins from the start.

The printed sheet 200 was thus sewn offset by 35 mm compared to the printed sheet 100 and is located, in relation to the back position, precisely in the centre of the book block.

The procedure is analogous when the positioning of the sub-format printed sheet 200 is to adopt a different position compared to the standard-format printed sheet 100, so different displacement paths then have to be covered.

It is now possible according to an embodiment of the invention to position sub-format sheets with a shorter back length within a book block in any desired position and fully automatically.

The system is also suitable to provide that the auxiliary saddle 1 can be equipped with two entrainer chains operating independently of one another, one entrainer chain operating exclusively for standard-format printed sheets, while the newly provided entrainer chain specifically transports sub-format printed sheets, and consequently only intervenes when it is a question of conveying sub-format printed sheets. Obviously, the first entrainer chain then has to have an operative connection in terms of the cycle with the second, so that the sewing saddle is not overstrained by too rapid a delivery of printed sheets.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless otherwise indicated by context. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" should be interpreted as including any singular entity from the listed elements, e.g., A, any subset from the listed elements, e.g., A and B, or the entire list of elements A, B and C.

What is claimed is:

1. A method for operating a thread sewing machine to process printed sheets to form book blocks, the method comprising:

transporting the printed sheets lying astride a first transport section of a transport system, the first transport section being operated by a conveying mechanism, the conveying mechanism being operated with a speed change that depends on a direct sequence of different sheet lengths of the printed sheets;

feeding the printed sheets from the first transport section to a second transport section of the transport system, the second transport section being operated by a conveying device having at least one of a controller and an operative connection to a stop so as to ensure an individual positioning of a sub-format printed sheet relative to a standard-format printed sheet; and feeding the printed sheets from the second transport section to a downstream sewing station, wherein the speed change includes an acceleration of the sub-format printed sheet which is transported in an intermediary manner along the first transport section and a delay of the standard-format printed sheet which is transported along the first transport section after the sub-format sheet.

2. The method according to claim 1, wherein the individual positioning of the sub-format printed sheet relates to a position, which, relative to the standard-format printed sheet, is initiated aligned on a head side, aligned on a foot side or in an intermediary manner.

3. The method according to claim 1, wherein a positioning of the stop in relation to a respective format of the printed sheet is achieved by at least one of:

providing a substantially horizontal controlled movement along a length of the second transport section; and producing, by the stop, the positioning by a substantially perpendicular controlled movement from a plane of the second transport section.

4. The method according to claim 1, further comprising detecting, using sensors, a local position and time with respect to the printed sheets passing the sensors, the sensors being disposed at a transition within the first transport section, between the first transport section and the second transport section and within the second transport section, signals detected by the sensors being fed to a central controller which operates the thread sewing machine.

5. The method according to claim 4, further comprising confirming, by the controller, on the basis of the incoming detected signals, a continuous operation of the thread sewing machine or triggering a shutdown of the thread sewing machine during disturbances in the feeding of the printed sheets.

6. The method according to claim 1, wherein a further detecting unit within the first transport section carries out the following steps:

a) triggering an interim acceleration of an entrainer chain belonging to the first transport section in case of transporting the sub-format printed sheet, b) inserting an idle cycle without feeding of a printed sheet following the sub-format printed sheet, and c) triggering a delay of the entrainer chain in case of the standard-format printed sheet following the idle cycle.

7. The method according to claim 6, wherein the feeding of the printed sheets from the second transport section occurs in cycles, and wherein the acceleration and the delay of the entrainer chain belonging to the conveying mechanism are configured such that, within a path section of the first transport section, the different sheet lengths between the standard-format and the sub-format printed sheet or between the sub-format and the standard-format printed sheet are picked up in such a way that at least the front edge of the printed sheets in a conveying direction pass a transition between the first and second transport sections at a time corresponding to a same part of the cycles of the second transport section.

8. The method according to claim 1, wherein the first transport section is operated by first and second entrainer chains, the first entrainer chain being used to transport the standard-format printed sheet and the second entrainer chain being used to transport the sub-format printed sheet.

9. The method according to claim 1, further comprising, during a manual placing of one of the printed sheets on the first transport section, stopping the thread sewing machine after a predetermined control sequence and starting operating again when a manual operation is fully completed.

10. The method according to claim 1, wherein the transport system is operated by means of a controller or has an operative connection to at least one stop in such a way that the book blocks with a different format are processed, the book blocks uniformly consisting of standard-format printed sheets or being equipped with sub-format printed sheets.

11. The method according to claim 1, wherein the transport system is operated by means of a controller or has an operative connection to at least one stop in such a way that the book blocks with a same or different format are equipped with at least one of a same or different number, position and size of sub-format printed sheets.

12. A method for operating a thread sewing machine to process printed sheets to form book blocks, the method comprising:

transporting the printed sheets lying astride a first transport section of a transport system, the first transport section being operated by a conveying mechanism, the conveying mechanism being operated with a speed change that depends on a direct sequence of different sheet lengths of the printed sheets, wherein a further detecting unit within the first transport section carries out the following steps:

a) triggering an interim acceleration of an entrainer chain belonging to the first transport section in case of transporting a sub-format printed sheet, b) inserting an idle cycle without feeding of one of the printed sheets following the sub-format printed sheet, and c) triggering a delay of the entrainer chain in case of a standard-format printed sheet following the idle cycle;

feeding the printed sheets from the first transport section to a second transport section of the transport system, the second transport section being operated by a conveying device having at least one of a controller and an operative connection to a stop so as to ensure an individual positioning of the sub-format printed sheet relative to the standard-format printed sheet; and feeding the printed sheets from the second transport section to a downstream sewing station.

13. The method according to claim 12, wherein the individual positioning of the sub-format printed sheet relates to a position, which, relative to the standard-format printed sheet, is initiated aligned on a head side, aligned on a foot side or in an intermediary manner.

14. The method according to claim 12, wherein a positioning of the stop in relation to a respective format of the printed sheet is achieved by at least one of:

providing a substantially horizontal controlled movement along a length of the second transport section; and producing, by the stop, the positioning by a substantially perpendicular controlled movement from a plane of the second transport section.

15. The method according to claim 12, wherein the feeding of the printed sheets from the second transport section occurs in cycles, and wherein the acceleration and the delay of the entrainer chain belonging to the conveying mechanism are configured such that, within a path section of the first transport section, the different sheet lengths between the standard-format and the sub-format printed sheet or between the sub-format and the standard-format printed sheet are picked up in such a way that at least the front edge of the printed sheets in a conveying direction pass a transition between the first and second transport sections at a time corresponding to a same part of the cycles of the second transport section.

16. The method according to claim 12, wherein the first transport section is operated by first and second entrainer chains, the first entrainer chain being used to transport the standard-format printed sheet and the second entrainer chain being used to transport the sub-format printed sheet.

17. The method according to claim 12, further comprising, during a manual placing of one of the printed sheets on the first transport section, stopping the thread sewing machine after a predetermined control sequence and starting operating again when a manual operation is fully completed.

18. A method for operating a thread sewing machine to process printed sheets to form book blocks, the method comprising:

transporting the printed sheets lying astride a first transport section of a transport system, the first transport section being operated by a conveying mechanism, the conveying mechanism being operated with a speed change that depends on a direct sequence of different sheet lengths of the printed sheets, the first transport section being operated by first and second entrainer chains, the first entrainer chain being used to transport a standard-format printed sheet and the second entrainer chain being used to transport a sub-format printed sheet;

feeding the printed sheets from the first transport section to a second transport section of the transport system, the second transport section being operated by a conveying device having at least one of a controller and an operative connection to a stop so as to ensure an individual positioning of the sub-format printed sheet relative to the standard-format printed sheet; and feeding the printed sheets from the second transport section to a downstream sewing station.

19. The method according to claim 18, wherein the individual positioning of the sub-format printed sheet relates to a position, which, relative to the standard-format printed sheet, is initiated aligned on a head side, aligned on a foot side or in an intermediary manner.

20. The method according to claim 18, wherein a positioning of the stop in relation to a respective format of the printed sheet is achieved by at least one of:

providing a substantially horizontal controlled movement along a length of the second transport section; and producing, by the stop, the positioning by a substantially perpendicular controlled movement from a plane of the second transport section.

21. The method according to claim 18, further comprising detecting, using sensors, a local position and time with respect to the printed sheets passing the sensors, the sensors being disposed at a transition within the first transport section, between the first transport section and the second transport section and within the second transport section, signals detected by the sensors being fed to a central controller which operates the thread sewing machine.

22. The method according to claim 21, further comprising confirming, by the controller, on the basis of the incoming detected signals, a continuous operation of the thread sewing machine or triggering a shutdown of the thread sewing machine during disturbances in the feeding of the printed sheets.

23. The method according to claim 18, further comprising, during a manual placing of one of the printed sheets on the first transport section, stopping the thread sewing machine after a predetermined control sequence and starting operating again when a manual operation is fully completed.

* * * * *